US006083074A

United States Patent [19]

Shutt

[11] Patent Number: 6,083,074

[45] Date of Patent: Jul. 4, 2000

[54] TOY SPEEDBOAT APPARATUS

[76] Inventor: Sidney Gardner Shutt, 612 Briarwood Dr., Brea, Calif. 92821

[21] Appl. No.: 09/295,461

[22] Filed: Apr. 13, 1999

[51] Int. Cl.[7] ..... A63H 23/02; A63H 27/14

[52] U.S. Cl. ..... 446/163; 446/153; 446/64

[58] Field of Search ..... 446/153, 160, 446/163, 164, 165, 64, 65, 88, 429, 430, 486

[56] References Cited

U.S. PATENT DOCUMENTS

| | | | |
|---|---|---|---|
| 1,744,904 | 1/1930 | Kelly | 446/164 |
| 1,949,757 | 3/1934 | Murdoch | 446/160 |
| 2,314,057 | 3/1943 | Slotsky et al. | 446/163 |
| 2,351,542 | 6/1944 | Paull | 446/163 |
| 2,857,708 | 10/1958 | Hirsch et al. | 446/163 |
| 3,557,488 | 1/1971 | Nielson | 446/165 |
| 3,590,518 | 7/1971 | LeBaron | 446/64 |
| 4,409,753 | 10/1983 | D'Andrade et al. | 446/164 |

FOREIGN PATENT DOCUMENTS

| | | | |
|---|---|---|---|
| 617716 | 2/1949 | United Kingdom | 446/64 |

*Primary Examiner*—Robert A. Hafer
*Assistant Examiner*—Laura Fossum

[57] ABSTRACT

A toy speedboat apparatus is given that glides on a water surface. Three planing surfaces are arranged to give stable, repeatable coasting runs. The drag is independent of velocity and the planing surface angle relative to the water surface is optimized to give minimum drag. A propelling means converts stored energy to give a high speed initial velocity producing long gliding runs in excess of 100 feet.

1 Claim, 2 Drawing Sheets

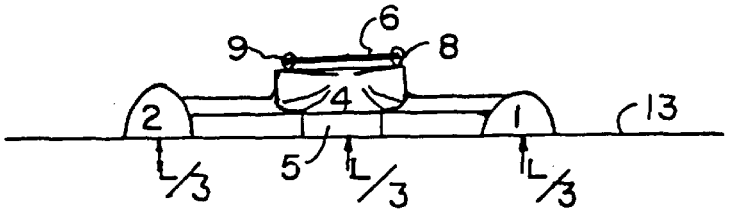
FIG. 4
FIG. 5
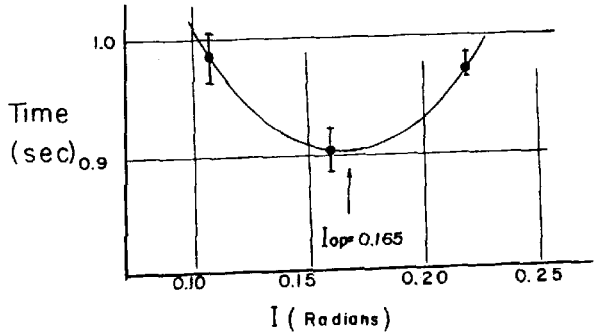
FIG. 6
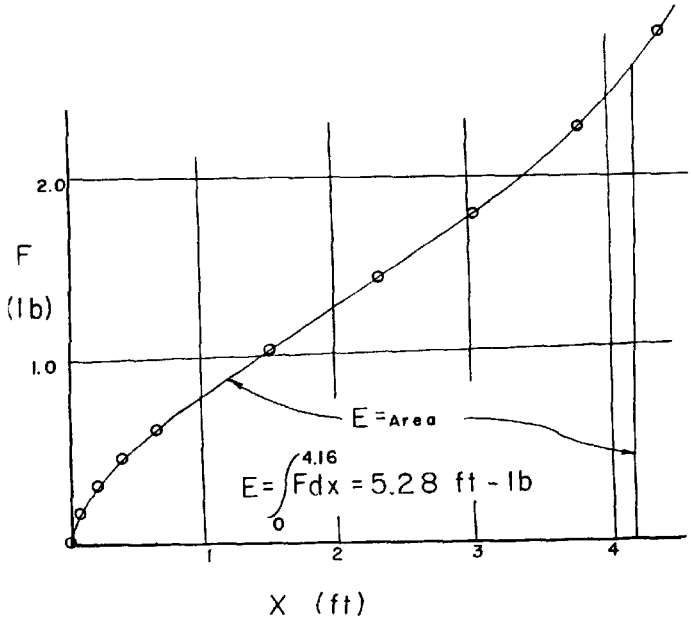

TOY SPEEDBOAT APPARATUS

BACKGROUND OF INVENTION

1. Field of Invention

This invention relates to the field of toy marine vessels and more particularly to the field of boats using three planing surfaces fixed at optimum angle and position. This invention pertains more particularly to the field of toy boats that are launched with released stored energy. It pertains more specifically to a toy speedboat that operates at good speed for long distances.

2. Prior Art

Hydrofoil lifting surfaces designed to apply a lifting force to the hull of a marine vessel are known in the art. Planing surfaces attached to the hydrofoil are used to control the angle of attack to produce the desired lift.

U.S. Pat. No. 4,711,195 titled "Hydrofoil Apparatus" issued Dec. 8, 1987 and having the same inventor as the subject invention characterizes a hydrofoil human powered boat that uses a planing surface to ride on the water surface to control the angle of attack of the hydrofoil. FIG. 3 of U.S. Pat. No. 4,711,195 shows the planing surface, but makes no provision to maintain an optimum angle to give minimum drag.

U.S. Pat. No. 3.762,353 titled "High Speed Sail Boat" issued Oct. 2, 1973 and having the same inventor as the subject invention characterizes planing surfaces to control hydrofoils in a sail boat. Again, the planing surface is used to control the angle of the hydrofoil and no precision is included to establish the angle between the planing surface and the water surface to give minimum drag.

SUMMARY OF INVENTION

It is the first object of the subject invention toy speedboat apparatus to arrange the operating parts to give stable gliding operation moving on the water surface. Three planing surfaces are used, two at the bow spaced by a cross arm, and one at the rear. FIG. 1 shows the layout of parts to accomplish the first objective.

It is the second objective of the subject invention to achieve long gliding runs. This is accomplished by making the angle between the planing surfaces and the water surface at the optimum angle to give minimum drag. Also, the drag is made independent of velocity so that long gliding runs at high speed are achieved with the toy speedboat.

It is the third objective of the subject invention to give the toy speedboat initial high velocity by using the release of a stored energy source.

It is the general objective of the subject invention toy speedboat apparatus to achieve a simple toy that looks like a real speedboat in producing long, stable, repeatable gliding runs skimming over water.

BRIEF DESCRIPTION OF DRAWINGS

FIG. 4 shows the front view of the toy speedboat;

FIG. 5 shows the optimum angle between the planing surface and the water surface that gives minimum drag, FIG. 6 shows the energy stored in the elastic propelling device.

PREFERRED EMBODIMENT

Figure 1:
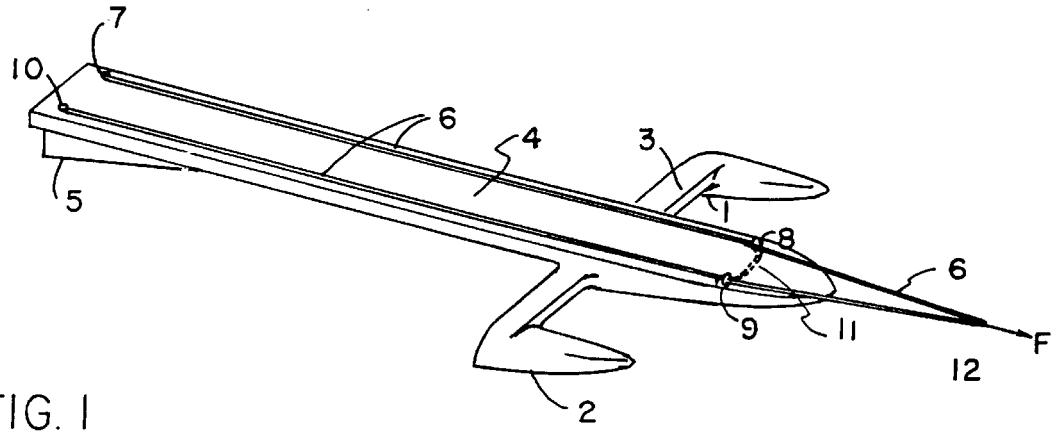
FIG. 1 is a perspective view of the toy speedboat.

FIG. 1 is a perspective view showing the invention toy speedboat apparatus. The invention shown has three planing surfaces, two planing surfaces 1 and 2 held in position by cross arm 3. Cross arm 3 is held in position at the front of the body 4. A single planing surface 5 is attached to the rear of the body 4. One end of an elastic band 6 is attached at the rear of the body 4 at 7. The elastic band 6 runs the length of the body, goes through screw eye 8, crosses to the opposite side of the body 4 and goes through a second screw eye 9 and runs back to the rear of the body 4 and attaches at 10. The relaxed elastic band length is shown in FIG. 1 by the dotted line 1 and the stretched out elastic band is shown at 12.

Figure 2:
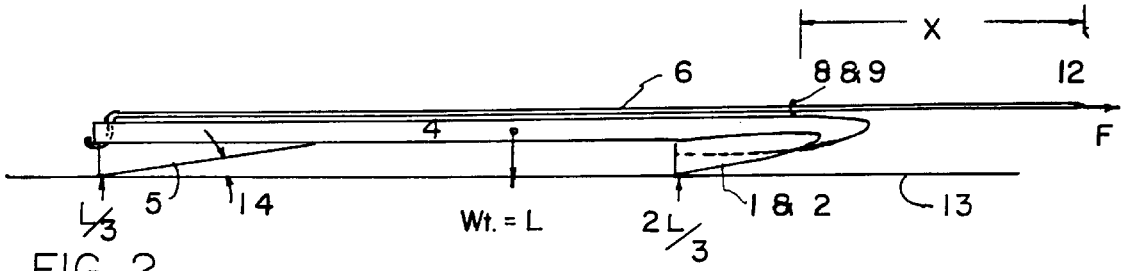
FIG. 2 shows the side view of the toy speedboat.

FIG. 2 shows the side view of the toy speedboat apparatus. Referring to FIG. 2 the water surface is shown by a line 13. The angle the planing surfaces make with the water surface 14 is made at an optimum angle to give minimum drag. The lift of the planing surfaces is equal to the toy speedboat weight. This embodiment makes the drag low and independent of the velocity which leads to long gliding runs.

Figure 3:
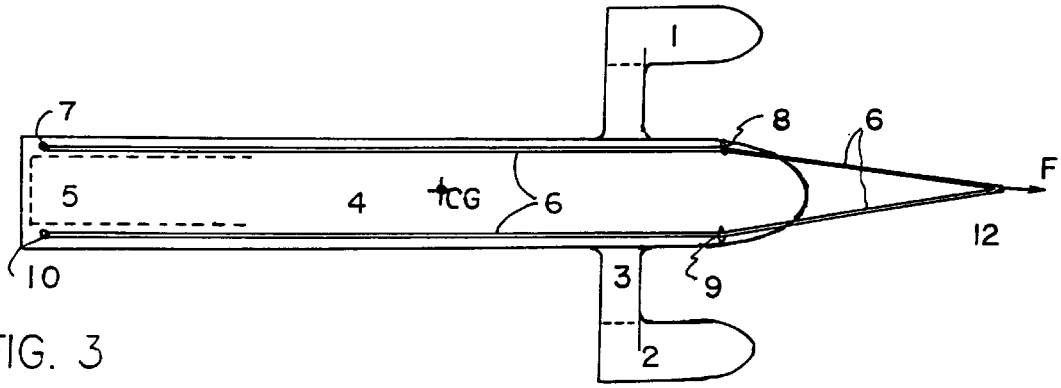
FIG. 3 shows the top view of the toy speedboat.

FIG. 3 shows the top view of the toy speedboat apparatus. Referring to FIG. 3 the planing surfaces 1,2, and 5 are supported by the cross arm 3 and the body 4 and are positioned to give stability in pitch roll, and yaw. Initial velocity is achieved by holding the toy speedboat planing surfaces 1,2, and 5 to the water surface while stretching the elastic band 6 several feet ahead of its bow as indicated at 12. When the toy speedboat is released it is propelled forward much like a sling shot. The elastic band is held in position by the screw eyes 8 and 9 at 11 during the coast part of a run. In a good launch all planing surfaces stay on the water and the toy speedboat will glide with stability about roll, pitch, and yaw at good speed for considerable distance. After some practice in launching the toy speedboat it will give many consecutive fast runs of long distances.

OPERATION AND ANALYSIS

The three equations that are assumed to be correct to the accuracy of importance are as follows:

$$L=C_L \cdot A \cdot V^2 \tag{1}$$

$$C_L=k \cdot I \tag{2}$$

$$D=C_d \cdot A \cdot V^2+LI \tag{3}$$

where: L is the lift of the planing surfaces equal to the weight (pounds)

A is the area of the planing surface in contact to the water (feet squared)

V is the velocity relative to the water (feet/seconds)

$C_L$ is the lift coefficient k is a constant

I is the angle between the planing surface and the water surface (radian)

D is the drag (pounds)

$C_d$ is the drag coefficient

If equation (2) is combined with equation (1) to determine A and is substituted into equation (3) the result is $$D = L \cdot \left(\frac{C_d}{k \cdot I} + I\right) \tag{4}$$

and the drag is independent of velocity and depends only on parameters that are very nearly constant at all velocities during a run.

There is an optimum angle . I . for lowest drag. This is found by equating the differential of D with respect to I to zero $$\frac{d}{dI}D = L\cdot\left(1-\frac{C_d}{k\cdot I^2}\right)=0 \quad \text{and} \tag{5}$$

$$I_{op}=\sqrt{\frac{C_d}{k}}$$

$$C_d = k\cdot(I_{op})^2$$

If equation (5) is combined with equation (4) it gives $D=\cdot L\cdot I_{op}$ (6)

The stored energy, E, in a stretched rubber band of two strands with cross section of ⅛ by 1/32 each per strand with a 9 inch free length will store at least 5 foot-pounds of energy in its stretched state. This energy is converted to kinetic energy at the point of release of the toy speedboat giving rise to its initial velocity.

It follows from the well known equation, F=ma, that $$E=\int_0^s F\,dx \quad \text{and} \quad E=\frac{m}{2}\cdot v^2 \tag{7}$$

where

E is the energy stored in the rubber before release (ft.-lb.)

F is the force acting on the toy speedboat (lb)

m is the mass of the toy speedboat (slugs )

V is the initial velocity at the launch at the point where the stored energy is zero (ft/sec) The initial velocity is given by $$v_i=\sqrt{\frac{2\cdot E}{m}} \tag{8}$$

After launch the energy is dissipated as the toy speedboat slows during its travel along a speed run. At the end of the run the energy reduces to zero and it stops. During the coast part of the run the force, F, acting on the toy speedboat is equal to the drag, D. Since D is constant the integral in equation (7) is equal to Ds. At the end of the run the stored energy, E, is equal to the dissipated energy, Ds. The distance the toy speedboat travels in a run is then $$E=\int_0^s D\,dx, \quad s=\frac{E}{D} \tag{9}$$

The first test model weighed 0.13 lb so that L=0.13lb. It went s=85ft. with stored energy of E=4.2 ft-lb. The drag was estimated to be D=0.049lb using equation (9). The optimum planing angle using equation (6) is then expected to be near 0.19 radian.

A test model was built weighing 0.120 pounds to a configuration similar to that shown in FIGS. 1 and 2. This model was built so that the planing angle was first sit at 0.106, then changed to 0.158 then to 0.218 radian. At each configuration the time for several runs of each was made. The mean and standard deviation of these measurements is shown in FIG. 5.

The optimum angle, $I_{op}$, was determined to be 0.165 radian. This information allows determination of the drag to be computed by using equation (6) to be $$D=2\cdot L\cdot I_{op}=0.040 \text{ pounds} \tag{10}$$

A toy speedboat was made to the configuration shown in FIG. 1 with the planing surface angles of near optimum value (0.165±0.006 radian ), with a weight of 0.115 lb. Stored energy in the elastic rubber launch mechanism is in excess of 4.0 ft-lb. The initial velocity is 47 ft/sec evaluated from equation (8). The coast distance from equation (9 & 10) is 100 feet.

Many runs were made that were in excess of 100 feet. The longest run measured 132 feet. This toy speedboat went the length of a 75 foot swimming pool in 1.7 seconds, looked like a real speedboat and jumped ten feet in the air when it stopped at the far end of the pool.

I claim:

1. A planing toy speedboat comprising:

an elongated body defining a top side, a bottom side, a front end, a back end and a longitudinal axis;

a first planing surface extending from said bottom side at said back end, said first planing surface defined by a sloping lower surface;

an elongated cross arm having a top side, a bottom side, first and second ends and a longitudinal axis, said elongated cross arm extending from said bottom side of said elongated body at a point equidistant between said first and second ends of said elongated cross arm and near said front end of said elongated body, said longitudinal axis of said cross arm being perpendicular to said longitudinal axis of said elongated body;

second and third planing surfaces extending from said bottom side of said elongated cross arm at said first and second ends, said second and third planing surfaces being equally spaced from said elongated body and each defined by lower sloping surfaces, each of said lower sloping surfaces of said first, second and third planing surfaces are parallel to each other and are disposed at an angle, when resting on a flat surface, said angle sloping such that a front end of each of said planing surfaces is closer to the elongated body than a back end of said planing surfaces; and a rubber elastic band attached to said top side of said elongated body and extending through two eyes and being constructed to catapult the toy speedboat when a user pulls and releases the rubber elastic band, wherein said toy speed boat, particularly said sloping lower surfaces and said rubber elastic band catapult, is designed to provide consistent long, fast glides of the toy speed boat on a surface of water with minimum drag and maximum distance simulating the action of an actual speed boat.

* * * * *